US007764017B2

(12) United States Patent
Fujitani et al.

(10) Patent No.: US 7,764,017 B2
(45) Date of Patent: Jul. 27, 2010

(54) PLASMA DISPLAY PANEL

(75) Inventors: Morio Fujitani, Osaka (JP); Keisuke Sumida, Osaka (JP); Shinichiro Ishino, Shiga (JP); Kenichi Kusaka, Osaka (JP)

(73) Assignee: Panasonic Corporation, Osaka (JP)

( * ) Notice: Subject to any disclaimer, the term of this patent is extended or adjusted under 35 U.S.C. 154(b) by 395 days.

(21) Appl. No.: 12/065,229

(22) PCT Filed: Aug. 7, 2007

(86) PCT No.: PCT/JP2007/065393

§ 371 (c)(1),
(2), (4) Date: Feb. 28, 2008

(87) PCT Pub. No.: WO2008/018424

PCT Pub. Date: Feb. 14, 2008

(65) Prior Publication Data

US 2009/0102378 A1 Apr. 23, 2009

(30) Foreign Application Priority Data

Aug. 10, 2006 (JP) ..... 2006-218092

(51) Int. Cl.
*H01J 17/49* (2006.01)
*H01J 9/00* (2006.01)

(52) U.S. Cl. ..... 313/587; 445/24

(58) Field of Classification Search ..... 313/582–587
See application file for complete search history.

(56) References Cited

U.S. PATENT DOCUMENTS 5,557,168 A * 9/1996 Nakajima et al. ..... 313/586
6,417,620 B1 * 7/2002 Yasue ..... 313/587
2002/0024303 A1 * 2/2002 Sano et al. ..... 313/582

(Continued)

FOREIGN PATENT DOCUMENTS

JP 2001-93425 4/2001

(Continued)

OTHER PUBLICATIONS

International Search Report issued Sep. 4, 2007 in the International (PCT) Application No. PCT/JP2007/065393.

*Primary Examiner*—Nimeshkumar D Patel
*Assistant Examiner*—Steven Horikoshi
(74) *Attorney, Agent, or Firm*—Wenderoth, Lind & Ponack, L.L.P.

(57) ABSTRACT

A plasma display panel comprises front plate (20) having display electrode (24) formed on a glass substrate with discharge gap (50), and back plate (30) having barrier ribs (34) formed to divide discharge cells, and arranged in a manner to confront the front plate (20). The barrier ribs (34) comprise vertical barrier rib (34*a*) arranged in parallel to an address electrode and horizontal barrier rib (34*b*) arranged in a manner to cross the vertical barrier rib (34*a*), and the vertical barrier rib (34*a*) has a shape satisfying the formula of H1>H2>H3, where H1 denotes a height of it at crossing portion (56) with the horizontal barrier rib (34*b*), H2 a height at a position of the discharge gap (50) of the display electrode (24), and H3 a height at a predetermined point between the position of the discharge gap (50) and the position of the crossing portion (56) with the horizontal barrier rib (34*b*).

6 Claims, 4 Drawing Sheets

U.S. PATENT DOCUMENTS

2002/0063510 A1* 5/2002 Yura et al. ..... 313/483
2004/0201350 A1* 10/2004 Kwon et al. ..... 313/582

FOREIGN PATENT DOCUMENTS

JP 2001-126624 5/2001
JP 2004-158345 6/2004
JP 2007-200594 8/2007
JP 2007-200617 8/2007

* cited by examiner

PLASMA DISPLAY PANEL

This application is a U.S. national phase application of PCT International application PCT/JP2007/065393.

TECHNICAL FIELD

The present invention relates to a plasma display panel used for a display device.

BACKGROUND ART

With the growing popularity in recent years of large-size screen and wall-mounted televisions as the interactive information terminals, there are available many kinds of display devices for this purpose such as liquid crystal display panels, field emission displays, electro-luminescence displays, and the like. Among these display devices, plasma display panels (hereinafter referred to as "PDP") draw attention as being thin display devices for such reasons that they are the self-illuminant type capable of displaying exquisite images and easy to enlarge the screen size, and the development efforts are thus being made toward higher definition and larger screen sizes.

A PDP comprises a front plate having such structure elements as a display electrode, a dielectric layer and a protective layer formed thereon, and a back plate having such structure elements as an address electrode, barrier ribs and phosphor layers formed thereon, wherein the front plate and the back plate are arranged in a manner that they confront each other to internally form minute discharge cells, and their peripheries are sealed with a sealing material. The discharge cells are filled with a discharge gas comprised of a mixture of neon (Ne), xenon (Xe), and the like gases at a pressure of about 66,500 Pa (approx. 500 Torr).

On the front plate, the dielectric layer is formed to cover the display electrode and the protective layer is formed further to cover the dielectric layer, and that a metallic electrode of thick film is used partly for the display electrode to ensure a good electrical conductivity. This causes the protective layer to rise in an area around the display electrode, and makes the risen portion of the protective layer to come in contact locally with the barrier ribs when the front plate and the back plate are placed to confront each other. In such a condition, there has been a case that parts of the barrier ribs where the protective layer is in contact become damaged when the PDP receives vibration or impacts. Since the barrier ribs in the areas corresponding to the display electrode of the front plate are in the vicinity of discharge regions of the individual discharge cells, the phosphor layers are scattered by the damaged barrier ribs, which adversely affects discharging conditions in the discharge cells, thereby giving rise to such problems as an increase in discharge voltage, errant discharges to the adjoining discharge cells and point defects such as lighting errors.

Some techniques are known such as an example, in which the barrier ribs are composed of a double-layered structure, and a black porous layer having a principal ingredient of aluminum oxide ($Al_2O_3$) is formed on the barrier ribs as a cushioning material in order to prevent damages to the barrier ribs (refer to patent document 1, for example).

On the other hand, some other techniques relating to height of the barrier ribs are also known for the purpose of improving brightness of a PDP having barrier ribs of a lattice like configuration formed of vertical barrier ribs and horizontal barrier ribs, such as an example, in which heights of the barrier ribs are partially changed by providing salient portions on the vertical barrier ribs to improve an exhaust efficiency in the discharge spaces, and another example, in which ridges of the barrier ribs orthogonal to the address electrode are formed into a concaved configuration to ease exhausting and charging of gases (for example, refer to patent documents 2 and 3).

A demand exists, however, for further miniaturization of the discharge cells in response to the need of advancing high resolution of the display images in recent years. In order to achieve such fine discharge cells with high quality and high yield, and to realize display images of high quality, there still exists a demand to develop a novel discharge cell structure that is not liable to damages to the barrier ribs due to dropping or vibration in spite of their smaller wall thickness, and capable of reducing an effect of irregular discharges between the adjacent discharge cells, or discharge cross-talks.

On the other hand, although the patent document 1 discloses a barrier rib structure that improves robustness of the barrier ribs, it is considered not sufficient to avoid damages to the barrier ribs of thin walls such as those of minute discharge cells required for full high-definition televisions, and it is also not effective to prevent the discharge cross-talks between the adjacent discharge cells. Furthermore, even though the patent documents 2 and 3 disclose the examples relating particularly to height of the barrier ribs in view of improving efficiency of exhausting and charging the gases, as they pertain to the barrier rib structure of lattice like configuration effectual for improving brightness of the minute discharge cells, they are deemed not effective as means to prevent damages to the barrier ribs and suppressing the discharge cross-talks.

Patent Document 1: Japanese Patent Unexamined Publication, No. 2004-158345

Patent Document 2: Japanese Patent Unexamined Publication, No. 2001-093425

Patent Document 3: Japanese Patent Unexamined Publication, No. 2001-126624

SUMMARY OF THE INVENTION

A PDP of the present invention comprises a front plate and a back plate arranged in a manner to confront each other with a discharge space formed therebetween, the front plate having a display electrode comprised of a sustain electrode and a scan electrode formed on a glass substrate with a discharge gap, a dielectric layer formed to cover the display electrode and a protective layer formed on the dielectric layer, the back plate having an address electrode disposed on a substrate in an orientation orthogonal to the display electrode to constitute discharge cells, barrier ribs formed to divide the discharge cells and phosphor layers disposed in the discharge cells, wherein the barrier ribs comprise a vertical barrier rib arranged in parallel to the address electrode and a horizontal barrier rib arranged in a manner to cross the vertical barrier rib, and further wherein the vertical barrier rib has a shape satisfying a formula of $H1>H2>H3$, where H1 denotes a height of the vertical barrier rib at a crossing portion with the horizontal barrier rib, H2 a height of the vertical barrier rib at a position of the discharge gap of the display electrode, and H3 a height of the vertical barrier rib at a predetermined point between the position of the discharge gap and the position of the crossing portion with the horizontal barrier rib.

According to this structure, damages to the barrier ribs attributed to abutment of the barrier ribs against the front plate can be reduced in spite of small wall thickness of the minute discharge cells since the vertical barrier rib is in abutment against the front plate at the crossing portion between the vertical barrier rib and the horizontal barrier rib. In addition, this structure can achieve display images of high quality since it suppresses discharge cross-talks in a direction of the display electrode in the vicinity of the discharge gap.

REFERENCE MARKS IN THE DRAWINGS

Figure 1:
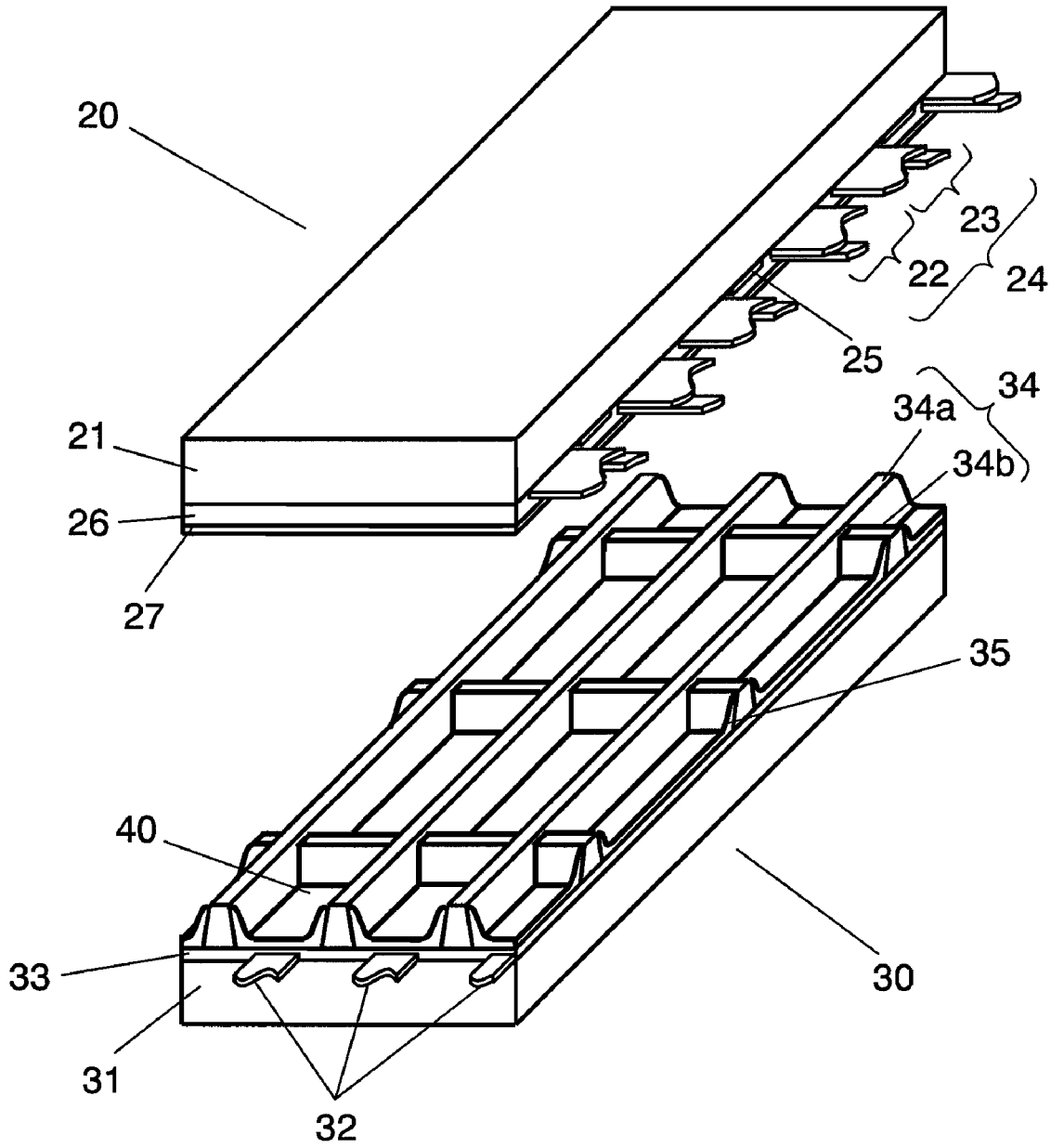
FIG. 1 is an exploded perspective view showing a structure of a PDP according to a first exemplary embodiment of the present invention.

20 front plate
21 front glass substrate
22 scan electrode
22*a* and 23*a* transparent electrode
22*b* and 23*b* bus electrode
23 sustain electrode
24 display electrode
25 shading layer
26 dielectric layer
27 protective layer
30 and 60 back plate
31 and 61 back glass substrate
32 and 62 address electrode
33 and 63 base dielectric layer
34 and 64 barrier rib
34*a* and 64*a* vertical barrier rib
34*b* and 64*b* horizontal barrier rib
35 phosphor layer
40 discharge space
50 discharge gap
51 discharge cell
52 non-discharge region
55 risen portion
56 and 65 crossing portion
66 and 67 protrusion

DETAILED DESCRIPTION OF PREFERRED EMBODIMENTS

Description is provided hereinafter of PDPs according to exemplary embodiments of the present invention with reference to the accompanying drawings.

First Exemplary Embodiment

Referring now to FIG. 1 to FIG. 4, description is provided of a PDP according to the first exemplary embodiment of this invention. FIG. 1 is an exploded perspective view showing a structure of the PDP of the first exemplary embodiment of this invention. As shown in FIG. 1, the PDP comprises front plate 20 and back plate 30, which are arranged in a confronting manner to form a discharge space between them. Front plate 20 has a plurality of display electrodes 24 formed in a striped pattern on front glass substrate 21, each of display electrodes 24 comprising a pair of scan electrode 22 and sustain electrode 23. There are shading layers 25 formed between adjoining display electrodes 24 to serve as optical shields. In addition, dielectric layer 26 is formed in a manner to cover display electrodes 24 and shading layers 25, and protective layer 27 containing magnesium oxide (MgO) is formed to cover dielectric layer 26.

Back plate 30 has address electrodes 32 formed on back glass substrate 31 in an orientation orthogonal to display electrodes 24 of front plate 20, and base dielectric layer 33 is provided to cover address electrodes 32. On top of base dielectric layer 33 are barrier ribs 34 formed in a lattice like configuration with vertical barrier ribs 34*a* of an orientation parallel to address electrodes 32 and horizontal barrier ribs 34*b* of another orientation orthogonal to address electrodes 32 and crisscrossing vertical barrier ribs 34*a*, and phosphor layers 35 formed on side surfaces of barrier ribs 34 as well as surfaces of base dielectric layer 33. Phosphor layers 35 comprise red phosphor layers for emitting red light, green phosphor layers for emitting green light and blue phosphor layers for emitting blue light, and they are formed in a sequential order corresponding to individual address electrodes 32 inside discharge spaces 40 divided and separated by adjoining barrier ribs 34.

Front plate 20 and back plate 30 are placed in a manner so that they confront each other with display electrodes 24 crisscrossing address electrodes 32, and their peripheries are sealed with a sealing material. Discharge spaces 40 are filled with a discharge gas such as a mixture of neon gas (Ne) and xenon gas (Xe), for instance. Image signal voltages are applied selectively to display electrodes 24 to cause electrical discharges inside the discharge gas and generate ultraviolet rays, which in turn excite phosphor layers 35 of the individual colors to illuminate red, green and blue colors to hence display color images.

Vertical barrier ribs 34*a* and horizontal barrier ribs 34*b* are formed in different heights, such that horizontal barrier ribs 34*b* are lower than vertical barrier ribs 34*a*, as shown in FIG. 1.

Figure 2:
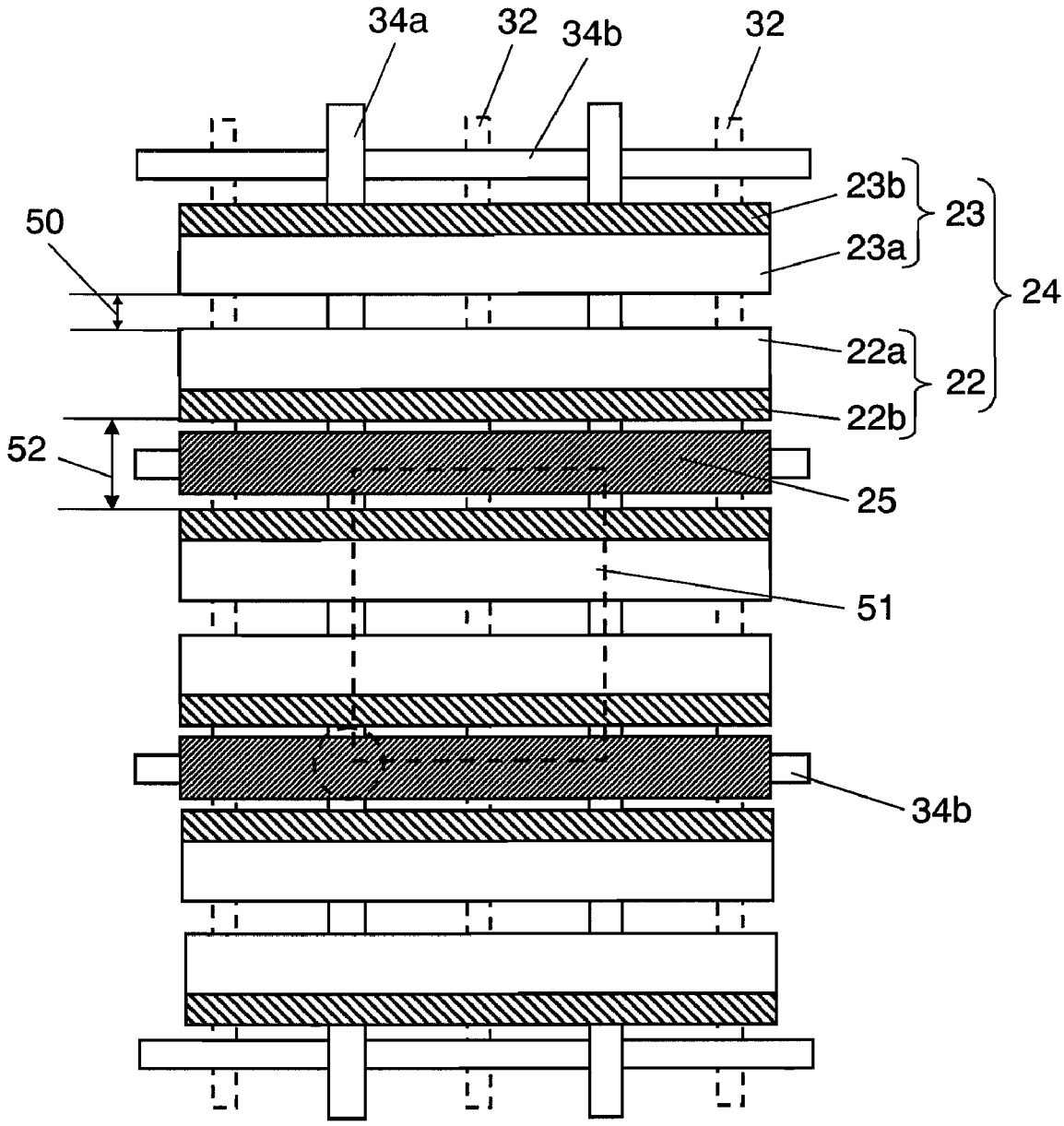
FIG. 2 is a plan view of the PDP according to the first exemplary embodiment of this invention, as observed from a position facing a front glass substrate of a front plate.

FIG. 2 depicts a plan view of the PDP, as observed from a position facing front glass substrate 21 of front plate 20. Display electrodes 24, each comprising a pair of scan electrode 22 and sustain electrode 23 are arranged across discharge gaps 50. A square area divided by vertical barrier ribs 34*a* and horizontal barrier ribs 34*b* where display electrode 24 crosses address electrode 32, as shown with the dotted line, constitutes discharge cell 51 which represents one unit of lighting regions. Spaces between adjoining discharge cells 51, or between adjoining display electrodes 24, constitute non-discharge regions 52, where shading layers 25 are formed in the corresponding areas on front glass substrate 21 to improve their contrast. Horizontal barrier ribs 34*b* are therefore formed in non-discharge regions 52, and shading layers 25 are formed in the spaces corresponding to horizontal barrier ribs 34*b*.

Figure 3:
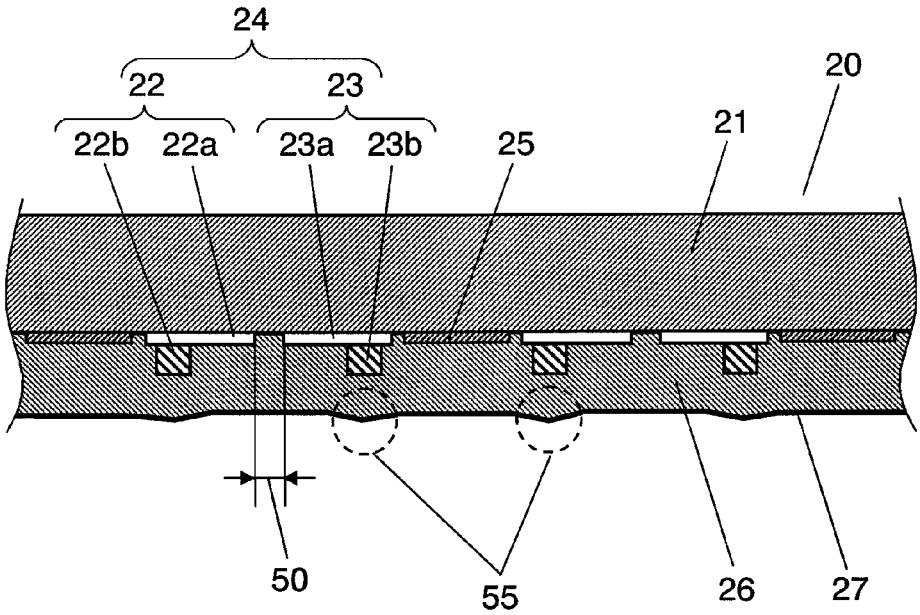
FIG. 3 is a cross sectional view of the front plate of the PDP according to the first exemplary embodiment of this invention, as observed in a direction perpendicular to a display electrode.

On the other hand, FIG. 3 depicts a cross sectional view of front plate 20 of the PDP according to the first exemplary embodiment of this invention, as observed in a direction perpendicular to display electrodes 24. Scan electrodes 22 and sustain electrodes 23 provided on front plate 20 to constitute display electrodes 24 include respective transparent electrodes 22*a* and 23*a*, and bus electrodes 22*b* and 23*b*, as shown in FIG. 3. Transparent electrodes 22*a* and 23*a* are made of thin layers of ITO or the like material to form discharge gaps 50, and they transmit the light generated in the discharge cells. Metal bus electrodes 22*b* and 23*b*, on the other hand, are formed of a material of good electrical conductivity such as silver (Ag) on top of their respective transparent electrodes 22*a* and 23*a* at the sides opposite discharge gaps 50.

Bus electrode 22*b* and 23*b* are formed of a silver material by such means as thick-film deposition method to ensure the electrical conductivity. As a result, dielectric layer 26 formed over display electrodes 24 produces risen portions 55 around the areas corresponding to bus electrodes 22*b* and 23*b*. Risen portions 55 appear on the surface of protective layer 27 since protective layer 27 is formed over dielectric layer 26 by means of thin-film deposition.

When front plate 20 and back plate 30 are so arranged as to make protective layer 27 of front plate 20 abut against vertical barrier ribs 34*a* of back plate 30, as shown in FIG. 2, the areas of protective layer 27 corresponding to the positions of bus electrodes 22*b* and 23*b* of front plate 20 come in contact to vertical barrier ribs 34*a* with a greater contact pressure than other areas, and therefore these areas produce an intense stress against the barrier ribs. It is necessary to give consideration to damages of barrier ribs 34 due to impressed stresses such as impacts and vibrations in the case of minute discharge cells required for full high-definition televisions because of their thin barrier wall thickness. Since these areas are in close proximity to the discharging regions in discharge cells 51, even a small crack of vertical barrier rib 34*a* can cause scattering of chipped phosphor layers 35 inside discharge cells 51 and adhering of the same to protective layer 27, which results in quality degradation of the display images due to an increase in the discharge voltage, lighting errors and the like.

Figure 4:
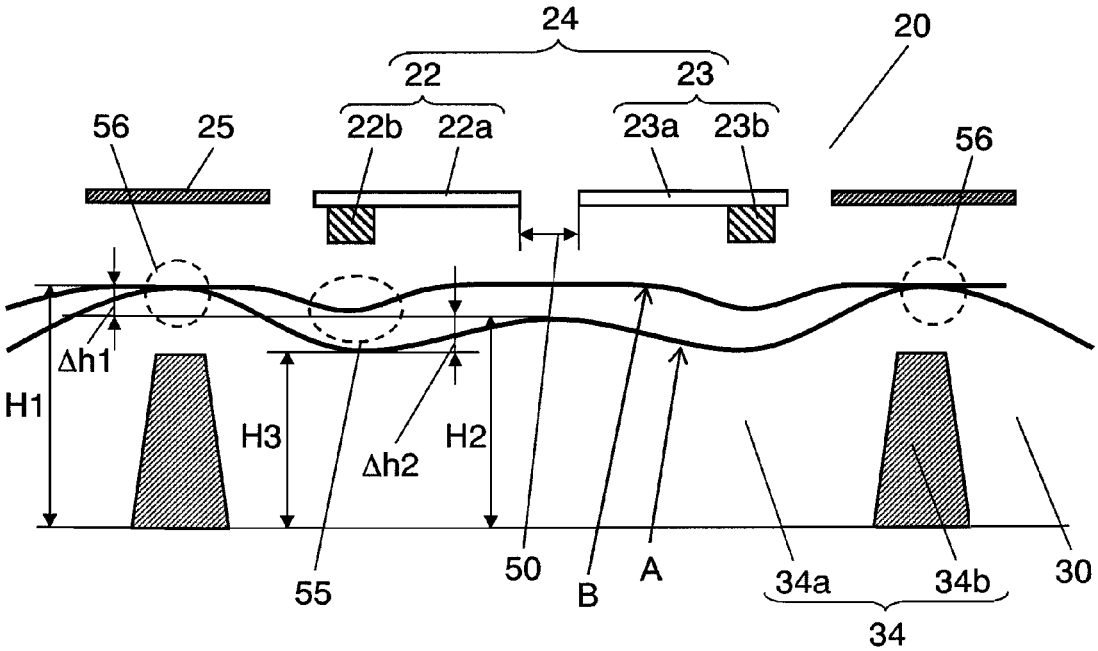
FIG. 4 is a schematic diagram illustrating a relation between a height-wise configuration of a vertical barrier rib and a surface configuration of a protective layer on the front plate of the PDP according to the first exemplary embodiment of this invention.

FIG. 4 is a schematic diagram illustrating a relation between a height-wise configuration of vertical barrier rib 34*a* and a surface configuration of the protective layer on front plate 20 of the PDP according to the first exemplary embodiment of this invention. FIG. 4 shows vertical barrier rib 34*a* and horizontal barrier ribs 34*b* of barrier rib 34 as parts of back plate 30, and the height-wise configuration of vertical barrier rib 34*a* is indicated by solid line "A". FIG. 4 also shows scan electrode 22 comprised of transparent electrode 22*a* and bus electrode 22*b*, sustain electrode 23 comprised of transparent electrode 23*a* and bus electrode 23*b*, and shading layer 25 provided in non-discharge region 52 formed between display electrodes 24 comprised of these electrodes as parts of front plate 20. The surface configuration of protective layer 27 formed on dielectric layer 26 is shown by solid line "B".

In the PDP of the first exemplary embodiment of this invention, when a height of vertical barrier rib 34*a* at crossing portion 56 with horizontal barrier rib 34*b* is denoted as H1, a height at another position corresponding to discharge gap 50 of display electrode 24 as H2, and a height at a predetermined position between the position of discharge gap 50 and the position of crossing portion 56 with horizontal barrier rib 34*b* as H3, as shown in FIG. 4, vertical barrier rib 34*a* is configured to satisfy the formula of H1>H2>H3. In addition, bus electrodes 22*b* and 23*b* are located in positions corresponding to predetermined positions denoted by H3. Here, the heights of the barrier rib are dimensions measured from the surface of base dielectric layer 33 formed to cover address electrodes 32 to the top portions of the barrier rib.

It is known that the surface of protective layer 27 on front plate 20 has risen portions 55 only in the areas corresponding to bus electrodes 22*b* and 23*b*, and other area is generally smooth. In this exemplary embodiment of the invention, therefore, vertical barrier ribs 34*a* are so configured that they abut upon the surface of protective layer 27 at crossing portions 56, and their heights are reduced in the areas corresponding to the positions of bus electrodes 22*b* and 23*b* so as not to contact with risen portions 55. In addition, vertical barrier ribs 34*a* have a height at the positions corresponding to discharge gaps 50 so that they leave small spaces to the surface of protective layer 27. In other words, the heights of vertical barrier ribs 34*a* are so configured that front plate 20 and back plate 30 are abutted against each other only at crossing portions 56 between the surface of protective layer 27 and vertical barrier ribs 34*a*, while they form slits above vertical barrier ribs 34*a* of such a dimension as not to allow any discharge cross-talks to adjoining discharge cells 51 through the slits in the positions of discharge gaps 50.

By making vertical barrier ribs 34*a* in abutment against front plate 20 only at the areas of crossing portions 56 where vertical barrier ribs 34*a* cross with horizontal barrier ribs 34*b*, other areas of vertical barrier ribs 34*a* can be kept not in contact with front plate 20. It is necessary to reduce the barrier wall thickness of vertical barrier ribs 34*a* especially for the minute discharge cells such as those of full high-definition televisions. Reduction of the barrier wall thickness not only weakens the physical strength to stresses, but also makes it difficult to control a surface roughness of the top portions of the barrier ribs. If the top portions of vertical barrier ribs 34*a* have rough surfaces in the areas adjacent to the discharge areas, vertical barrier ribs 34*a* can crack easily, which tends to cause degradation of the display images due to discharge errors and the like.

As has been described, front plate 20 and back plate 30 are abutted against each other only at crossing portions 56 between vertical barrier ribs 34*a* and horizontal barrier ribs 34*b*, which are the non-discharge regions and the areas corresponding to shading layers 25. As a result, there is never any influence to the quality of discharge phenomena in discharge cells 51 and the display images even if vertical barrier ribs 34*a* crack at areas around their crossing portions 56 since these areas are in the non-discharge regions and they are optically shielded by shading layer 25.

In the PDP according to the first exemplary embodiment of this invention, as shown in FIG. 4, it is desirable to make vertical barrier ribs 34*a* so that a difference Δh1 between barrier height H1 at crossing portions 56 and another barrier height H2 around the areas of discharge gaps 50 is in a range of 1 μm to 10 μm, and more preferably in a range of 1 μm to 7 μm in consideration of avoiding discharge cross-talks.

In addition, it is basically appropriate for a difference Δh2 between barrier height H3 corresponding to the positions of bus electrodes 22*b* and 23*b* and barrier height H2 around the areas of discharge gaps 50 as to be equal to or larger than a height of risen portions 55. However, the difference Δh2 of 9 μm or smaller is preferable, and between 3 μm and 5 μm is more preferable because of the possibility that discharge cross-talks can occur if the difference Δh2 becomes greater. It is further preferable to regulate the sum of Δh1 and Δh2 to be 10 μm or smaller.

In the PDP of the first exemplary embodiment of this invention, vertical barrier ribs 34*a* and horizontal barrier ribs 34*b* are formed in different heights, and that they have the structure of so-called a dual-height lattice like configuration, in which horizontal barrier ribs 34*b* are lower than vertical barrier ribs 34*a*. In the case of minute discharge cells, in particular, the barrier rib structure of the lattice like configuration is useful for improving quality of the display images such as improvement of brightness, and that the dual-height lattice like configuration is suitable in view of exhausting and charging the gases.

In this first exemplary embodiment of the invention, the above barrier rib structure of the dual-height lattice like configuration having vertical barrier ribs 34*a* of the well-controlled heights is achieved by means of the barrier rib deposition method using a photosensitive barrier rib material. In other words, a predetermined thickness of a barrier rib forming material layer, or a first layer consisting of a barrier rib material, a photosensitive resin material, etc. is coated on back glass substrate 31 having address electrodes 32 and base dielectric layer 33 formed thereon, and after dried, it is exposed to light using a pattern corresponding to the shape of horizontal barrier ribs 34*b*. After that, a predetermined thickness of the barrier rib forming material layer of the same compositions is coated on top of the above as a second layer, and after dried, it is again exposed to light using another pattern corresponding to the shape of vertical barrier ribs 34*a*. In this manner, the lattice like configuration having the vertical barrier ribs and the horizontal barrier ribs of different heights can be formed by developing the twice-exposed barrier rib forming material layers, and complete the barrier ribs of the dual-height lattice like configuration formed only of the barrier rib material when the photosensitive resin material is burnt off by a firing process.

That is, coating of the first layer is the barrier rib forming material layer corresponding to the height of the horizontal barrier ribs, and subsequent coating of the second layer is the barrier rib forming material layer corresponding to the difference in height between the vertical barrier ribs and the horizontal barrier ribs.

The present invention makes good use of the phenomenon that the barrier rib forming material of the second layer concentrates into the areas corresponding to the already light-exposed horizontal barrier ribs of the first layer by the effect of concentration diffusion of the solvent contained in the barrier rib forming material layer when the second layer of the barrier rib forming material is coated and dried on the partially exposed first layer of the barrier rib forming material. As a result, the thickness of the coated and dried second layer of the barrier rib forming material becomes larger at crossing portions 56 corresponding to the already exposed horizontal barrier ribs 34*b*, smallest at the areas corresponding to bus electrodes 22*b* and 23*b*, or neighboring crossing portions 56, and slightly increased at the areas corresponding to discharge gaps 50, as they correspond with the barrier heights shown in FIG. 4. In other words, the vertical barrier ribs have a varying thickness of symmetric configuration about discharge gap 50.

The second layer of the barrier rib forming material having the above-described varying thickness is exposed to light using the pattern corresponding to the shape of vertical barrier ribs 34*a*, developed, and burnt to complete barrier ribs 34 of the lattice like configuration having vertical barrier ribs 34*a* of varying barrier height shown in FIG. 4.

According to the first exemplary embodiment of this invention, the vertical barrier ribs having the prescribed height configuration is achieved by virtue of the physical property of the barrier rib forming material layers when coated several times and exposed several times by using the photosensitive barrier rib material, as discussed above. It is thus possible to freely control the barrier height as well as the height variation of vertical barrier ribs 34*a* shown in FIG. 4 to any dimension and configuration by adjusting material compositions of the barrier rib forming material layers, selecting the method of light exposure, and the like.

Second Exemplary Embodiment

Figure 5:
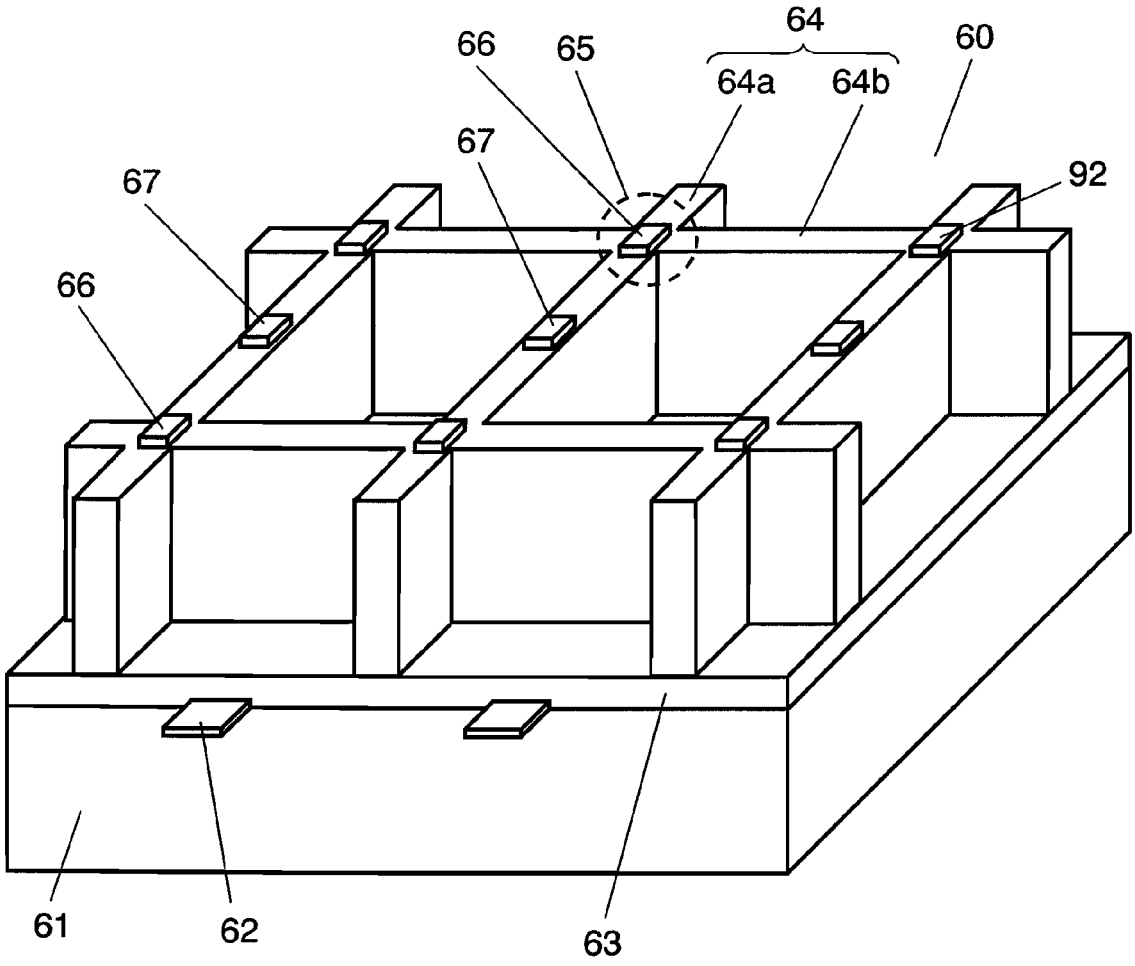
FIG. 5 is a perspective view showing a structure of a back plate of a PDP according to a second exemplary embodiment of the present invention.

FIG. 5 is a perspective view showing a structure of back plate 60 of a PDP according to the second exemplary embodiment of the present invention. In this second exemplary embodiment of the invention, description is provided of a barrier rib structure having vertical barrier ribs and horizontal barrier ribs of the same height when making the barrier ribs of a lattice like configuration. Except for the vertical barrier ribs and the horizontal barrier ribs of the same height, all other structural components including a front plate are analogous to those of the first exemplary embodiment, and details of them will therefore be skipped.

According to the second exemplary embodiment of this invention, back plane 60 of the PDP comprises address electrodes 62 formed on back glass substrate 61, base dielectric layer 63 formed to cover address electrodes 62, and barrier ribs 64 formed on base dielectric layer 63, as shown in FIG. 5.

Barrier ribs 64 comprise vertical barrier ribs 64*a* in parallel to address electrodes 62 and horizontal barrier ribs 64*b* criss-crossing vertical barrier ribs 64*a*, and they are formed into a lattice like configuration in the similar manner as the first exemplary embodiment. Both vertical barrier ribs 64*a* and horizontal barrier ribs 64*b* are formed generally in the same barrier height to each other.

There are protrusions 66 provided on top of crossing portions 65 where vertical barrier ribs 64*a* cross horizontal barrier ribs 64*b*, and protrusions 67 on top of vertical barrier ribs 64*a* in positions corresponding to discharge gaps 50 of front plate 20. Protrusions 66 are formed in a larger thickness than that of protrusions 67.

In the second exemplary embodiment of this invention, variation of the barrier height similar to that shown in FIG. 4 and discussed in the first exemplary embodiment is achieved by providing these protrusions 66 and 67 on vertical barrier ribs 64*a*. In other words, front plate 20 abuts only against protrusions 66 provided on crossing portions 65, and slits formed with vertical barrier ribs 64*a* in areas corresponding discharge gaps 50 are adjusted by protrusions 67. It is therefore possible to maintain the slits of a predetermined dimension between front plate 20 and vertical barrier ribs 64*a* at the positions corresponding to bus electrodes 22*b* and 23*b*.

As a result of the above, there can be the PDP of a minute discharge cell structure capable of reducing damages to the barrier ribs and suppressing discharge cross-talks.

Although protrusions 66 and 67 are shown in FIG. 5 as being a trapezoidal shape and formed locally, they can be formed in various ways without specific limitations. Besides, the screen printing method, sand blasting method and the like can be used as the means of forming vertical barrier ribs 64*a* and horizontal barrier ribs 64*b* of the same height. In addition, the pattern printing method, dispenser method, ink-jet method and the like means can be used to configure protrusions 66 and 67 of any given shape on top of vertical barrier ribs 64*a* formed by any of the above methods.

As has been described in the above exemplary embodiments of the invention, it is desirable that the front plate and the back plate are in abutment at all crossing portions over the entire surface of the PDP. However, it is not absolutely necessary to make abutment at all the crossing portions when there are variations in PDP's of large screen in the mass-production, since a sufficient effect is still attainable in this case.

In addition, the invention can provide the advantage of reducing damages to the barrier ribs even if there are areas of abutment other than the crossing portions due to local protrusions resulted by fillers present in the barrier ribs, or variations of the protrusions on the surface of the front plate, as long as the entire surfaces are in abutment mostly at the crossing portions.

In the exemplary embodiments of this invention, although reduction of damages to the barrier ribs and suppression of discharge cross-talks are achieved by controlling height variation of the barrier ribs, the like advantage of this invention can also be achieved by positively controlling a thickness configuration of the dielectric layer on the front plate.

INDUSTRIAL APPLICABILITY

As illustrated above, the present invention can provide a PDP capable of displaying images of high quality by reducing damages to the barrier rib in the discharge areas and suppressing discharge cross-talks, and thereby the PDP is useful for any image display device of large screen and high definition display.

The invention claimed is:

1. A plasma display panel comprising:

a front plate having a display electrode comprised of a sustain electrode and a scan electrode formed on a glass substrate with a discharge gap, a dielectric layer formed to cover the display electrode, and a protective layer formed on the dielectric layer; and a back plate arranged in a manner to confront the front plate with a discharge space formed therebetween, the back plate having an address electrode disposed on a substrate in an orientation orthogonal to the display electrode to compose discharge cells, barrier ribs formed to divide the discharge cells, and phosphor layers disposed in the discharge cells, wherein the barrier ribs comprise a vertical barrier rib arranged in parallel to the address electrode and a horizontal barrier rib arranged in a manner to cross the vertical barrier rib, and further wherein the vertical barrier rib has a shape satisfying a formula of $H1>H2>H3$, where H1 denotes a height of the vertical barrier rib at a crossing portion with the horizontal barrier rib, H2 a height of the vertical barrier rib at a position of the discharge gap of the display electrode, and H3 a height of the vertical barrier rib at a predetermined point between the position of the discharge gap and the position of the crossing portion with the horizontal barrier rib.

2. The plasma display panel of claim 1, wherein the sustain electrode and the scan electrode are each provided with a transparent electrode and a bus electrode, and the predetermined point between the position of the discharge gap and the position of the crossing portion with the horizontal barrier rib corresponds to a position of the bus electrode.

3. The plasma display panel of claim 1, wherein the horizontal barrier rib is formed in a non-discharge region in the discharge space.

4. The plasma display panel of claim 1 further comprising a shading layer formed on the front plate at a position corresponding to the horizontal barrier rib.

5. The plasma display panel of claim 1, wherein a barrier height of the horizontal barrier rib is smaller than a barrier height of the vertical barrier rib.

6. The plasma display panel of claim 1, wherein a difference $\Delta h1$ between the barrier height H1 at the crossing portion with the horizontal barrier rib and the barrier height H2 at the position of the discharge gap of the display electrode is expressed as $1\ \mu m<\Delta h1<10\ \mu m$, and a difference $\Delta h2$ between the barrier height H2 at the position of the discharge gap of the display electrode and the barrier height H3 at the predetermined point between the position of the discharge gap and the position of the crossing portion with the horizontal barrier rib is expressed as $3\ \mu m<\Delta h2<9\ \mu m$.

* * * * *